US005490543A

United States Patent [19]

Fujisawa

[11] Patent Number: 5,490,543

[45] Date of Patent: Feb. 13, 1996

[54] TWO-PLY WARP TWO-PLY WEFT PAPERMAKING FABRIC HAVING AUXILIARY WEFT YARNS INCORPORATED IN PAPERMAKING SIDE FABRIC

[75] Inventor: Shigenobu Fujisawa, Tokyo, Japan

[73] Assignee: Nippon Filcon Co., Ltd., Tokyo, Japan

[21] Appl. No.: 404,820

[22] Filed: Mar. 14, 1995

[30] Foreign Application Priority Data

Mar. 18, 1994 [JP] Japan ..... 6-085196

[51] Int. Cl.[6] ..... D03D 23/00

[52] U.S. Cl. ..... 139/383 A; 428/116; 428/225; 428/229; 428/257

[58] Field of Search ..... 428/225, 116, 428/229, 257; 139/383 A; 162/DIG. 1

[56] References Cited

U.S. PATENT DOCUMENTS 4,815,503 3/1989 Borel ..... 139/383 A
4,928,737 5/1990 Borel ..... 139/383 A
4,989,648 2/1991 Tate et al. ..... 139/383 A

*Primary Examiner*—James J. Bell
*Attorney, Agent, or Firm*—Beveridge, DeGrandi, Weilacher & Young

[57] ABSTRACT

A ply warp two-ply weft papermaking fabric having auxiliary weft yarns incorporated in a papermaking side fabric thereof, which papermaking fabric includes (a) an at least 3-shaft papermaking side fabric consisting of papermaking side warps and papermaking side weft yarns, forming long crimps of warps on the papermaking side thereof, and having auxiliary weft yarns of a smaller diameter than the warps incorporated in the papermaking side weft yarns, (b) a weft wear type running side fabric consisting of running side warps and running side weft yarns and having the running surface thereof formed of long crimp of the weft yarns, and (c) binding yarns intersecting the papermaking side warps on the upper side thereof and intersecting the travelling face side warps on the lower side thereof thereby connecting the papermaking side fabric and the running side fabric.

11 Claims, 3 Drawing Sheets

TWO-PLY WARP TWO-PLY WEFT PAPERMAKING FABRIC HAVING AUXILIARY WEFT YARNS INCORPORATED IN PAPERMAKING SIDE FABRIC

BACKGROUND OF THE INVENTION

This invention relates to a papermaking fabric, and more particularly to a two-ply warp two-ply weft papermaking fabric having auxiliary weft yarns incorporated in the papermaking side of the fabric.

Numerous requirements have been heretofore requested in connection with papermaking fabrics. For example, (1) the problems of paper quality itself such as imparting smoothness to the surface of paper, preventing the occurrence of wire marks, and ensuring thorough mixture of cellulosic fibers and the problem of the papermaking retention, (2) the improvement of resistance of the fabric to wear and the extension of service life of the fabric, and (3) the increase of rigidity and textural stability of the fabric and the insurance of the ability of the fabric to allow high drainage capability are particular subjects of desired requirements which have been made in the past. In many respects, these desired requirements are interrelated. Generally, the requirement of (1) mainly concerns a problem regarding the quality of the papermaking side of the fabric, the requirement of (2) mainly concerns a problem regarding the running side construction of the fabric, and the requirement of (3) concerns the problem relating to the entire fabric.

Heretofore, for the fulfillment of requirement (1), many proposals have been made for the one-ply warp two-ply weft yarn papermaker fabric. However, no device has ever been developed for perfectly fulfilling the requirement of (2), i.e. the improvement of the resistance of the papermaking fabric to wear. The highest technical level is only enough to prevent the warps of the papermaking fabric against wear by exposing the weft yarns of the fabric on the running side to abrasion.

In recent years, however, the upward trend of the operating speed of the paper machine, the ratio of filler in the fabric, and the demand for neutral papermaking has reached a point where the resistance of the papermaking fabric to wear poses an important problem.

Generally, from the viewpoint of the textural stability of the fabric while in service and the extension of the service life of the fabric, the running face side weft yarns of the fabric are desired to perform the role of resisting wear.

When the warps are worn, the fabric naturally suffers loss of tensile strength and elongation of size. When the wear continues until the warps are cut, the fabric directly breaks and its service life is terminated.

For the purpose of improving the resistance of the fabric to wear, an attempt has been made heretofore to use polyamide yarns capable of resisting wear for the running side weft yarns of the papermaking fabric. This attempt promises no epochal effect because it resides exclusively in utilizing the quality of a material to be used instead of altering the construction of a woven fabric itself. The papermaking fabric which uses polyamide type yarns is at a disadvantage in exhibiting a deficiency in textural stability.

Another attempt has been made to use yarns of a large diameter for the running side yarns of the papermaking fabric. This modification has contributed to improving the resistance to a certain extent. However, many problems have arisen from the practical point of view such as disturbing the balance between the warps and the weft yarns, impairing the crimping property of yarns, and creating a tendency for the occurrence of wire marks.

An idea of increasing the numbers of warps and weft yarns forming the fabric and their densities may be conceived for precluding the occurrence of wire marks on the paper produced. To realize this idea, the warps and the weft yarns severally require decreases in diameter.

In the well-known one-ply warp two-ply weft yarn fabric which is now in popular use, however, such decreases of diameters result in degrading such properties of the fabric as resistance to wear, rigidity, and textural stability.

When the diameters are increased conversely for the purpose of improving the fabric with regard to resistance to wear, rigidity, and textural stability, the fabric is compelled to sacrifice the smoothness of surface and inflicts a wire mark on the paper to be produced. Thus, the increases or decreases of the diameters in question entail a contradictory problem.

An attempt is now under way to solve the problems mentioned above with a fabric which is obtained by forming a papermaking side fabric and a running side fabric with several different warps and weft yarns and joining the two fabrics into a one-piece papermaking fabric with the aid of binding yarns.

To be specific, the papermaking side fabric is formed with high density by using warps and weft yarns both of a small diameter, and the running side fabric is formed with high resistance to wear by using warps and weft yarns both of a large diameter.

This attempt, however, has not necessarily brought about a fully satisfactory result. In the parts of binding in which binding yarns and papermaking side warps intersect, since the binding yarns draw the papermaking side fabric toward the running side and consequently give rise to recesses in the surface of the papermaking side fabric, the marks of these recesses are transferred onto the paper being actually produced on the papermaking fabric and eventually inflict a wire mark on the produced paper.

SUMMARY OF THE INVENTION

An object of this invention is to overcome the problems of the prior art mentioned above, and more particularly to provide a papermaking fabric which is still a woven fabric produced by forming a papermaking side fabric and a running side fabric with several different warps and weft yarns and joining these two fabrics into a one-piece composite with the aid of binding yarns and which avoids giving rise to recesses in the surface of the papermaking side fabric in the parts of binding in which the binding yarns are interlaced with the papermaking side fabric.

In achieving the above and other objects, one feature of this invention is directed to providing a two-ply warp two-ply weft papermaking fabric having auxiliary weft yarns incorporated in the papermaking side of the fabric. The papermaking fabric comprises (a) an at least 3-shaft papermaking side fabric consisting of papermaking side warps and papermaking side weft yarns, forming long crimps of warps on the papermaking side thereof, and having auxiliary weft yarns of a smaller diameter than the warps incorporated in the papermaking side weft yarns, (b) a weft yarn-abrasion type running side fabric consisting of running side warps and running side weft yarns and having the running side thereof formed of long crimps of the weft yarns, and (c) binding yarns intersecting the papermaking side warps on the upper side thereof and intersecting the running side warps on the lower side thereof thereby connecting the papermaking side fabric and the running side fabric.

In greater detail, the two-ply warp two-ply weft papermaking fabric of the invention can have binding parts formed by causing the binding yarns to intersect the papermaking side warps on the upper side thereof are disposed at the parts adjoining the positions at which the auxiliary weft yarns are disposed over the papermaking side warps.

The binding yarns can form binding parts by at least once intersecting papermaking side warps thereof within complete weaves of papermaking side weft yarns in the direction of weft yarns and within complete weaves and papermaking side warps in the direction of warps.

Generally, the numbers and densities of papermaking side warps and running side warps can be identical with the numbers and densities of papermaking side weft yarns and running side weft yarns. Typically, the diameter of the binding yarns can be smaller than the diameter of papermaking side weft yarns. The diameter of the running side weft yarns can be larger than the diameter of the papermaking side weft yarns. Also, the diameter of the running side warps can be larger than the diameter of the papermaking side warps.

In general, a plurality of the auxiliary weft yarns can be disposed between said papermaking side weft yarns. The auxiliary weft yarns can be disposed over warps at the positions at which one of the two non-adjoining papermaking side warps is directed from above the first weft yarn to below the next weft yarn between two adjoining papermaking side weft yarns and over warps at the positions at which the other warp is directed from below the first weft yarn to above the next weft yarn and the auxiliary weft yarns are at least once interwoven with papermaking side warps in a complete weave.

In another variation, the auxiliary weft yarns can be disposed over warps in the parts in which one of two adjoining papermaking side warps directed from above the first weft yarn to below the next weft yarn between two adjoining papermaking side weft yarns and the other warp directed from below the first weft yarn to above the next weft yarn intersect each other and the auxiliary weft yarns are at least once interwoven with the papermaking side warps in a complete weave. In all embodiments of the invention, the auxiliary weft yarns can be disposed over warps at the positions at which one of two non-adjoining papermaking side warps is directed from above the first weft yarn to below the next weft yarn between two adjoining papermaking side weft yarns and over warps at the positions at which the other warp is directed from below the first weft yarn to above the next weft yarn and further over warps sunken downward by being interwoven with weft yarns between the two warps and the auxiliary weft yarns are at least once interwoven with papermaking side warps in a complete weave.

BRIEF DESCRIPTION OF THE DRAWINGS

The invention will be further understood with reference to the drawings, wherein.

DETAILED DESCRIPTION OF THE INVENTION

Figure 3:
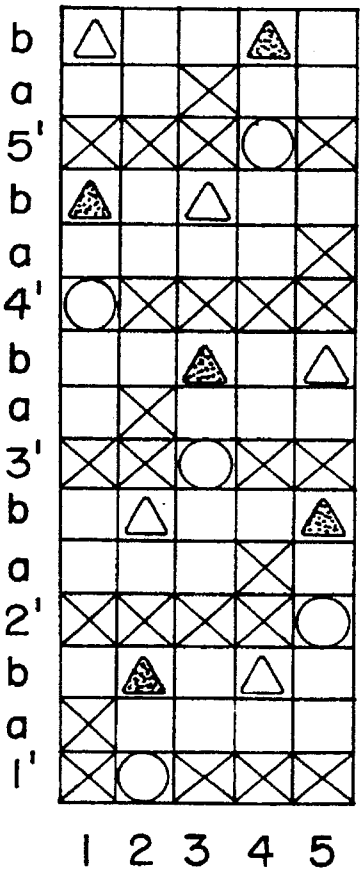
FIG. 3 is a design diagram showing a complete design of a repeating unit of yet another embodiment of this invention.

The salient feature of this invention resides in a papermaking fabric which comprises an at least 3-shaft papermaking side fabric forming long crimps of warps on the papermaking side thereof, consisting of papermaking side warps and papermaking side weft yarns, and having auxiliary weft yarns of a smaller diameter than the weft yarns incorporated in the papermaking side weft yarns, a weft wear type running side fabric having the running surface thereof formed of long crimps of running side weft yarns and consisting of running side warps and running side weft yarns, and binding yarns intersecting the papermaking side warps on the upper side thereof and intersecting the running side warps on the lower side thereof thereby connecting the papermaking side fabric and the running side fabric.

Owing to this construction, the papermaking side fabric is enabled to form a papermaking surface of high density with warps and weft yarns both of a small diameter and the running side fabric to form a running surface of high resistance to wear with warps and weft yarns both of a large diameter.

Further by having auxiliary weft yarns incorporated in the papermaking side fabric, there can be produced a papermaking side fabric which secures an ideal drainage capability, enjoys a high ability to support fibers, possesses only a small capacity for holding water, and abounds in smoothness of surface.

The papermaking side fabric has long crimps of warps arranged in parallel on the papermaking side thereof, whereas long crimps of weft yarns are formed on the running surface. Since the parallel warps are pushed downward by the knuckles of weft yarns serving to interweave these warps and, and as a result, sunken downward inevitably between the knuckles, the knuckles of weft yarns are caused to protrude therebetween and give rise to irregularities of surface.

The occurrence of these irregularities of surface grows in conspicuity in proportion as the number of shafts increases.

When the slurry of paper stock is supplied to the papermaking fabric in motion, the fibers of the paper stock are naturally oriented in the direction of motion of the papermaking fabric and are piled between the long crimps of the parallel warps or lodged thereunder. When the fibers are stuck between the long crimps of warps, the drainage capability of the papermaking fabric is degraded and the vacuum pressure used for removal of water from the slurry must be increased. Thus, the possibility of the fabric inflicting a wire mark on the produced paper is increased.

The inventor has been ascertained that for the solution of this problem, auxiliary weft yarns having a smaller diameter than the papermaking side weft yarns must be interposed between the papermaking side weft yarns.

The density of weft yarns must be increased to improve the fabric's ability to retain the paper stock. The increase in the density of weft yarns entails the problem of lowering the drainage capability. In order for the fabric to secure an ideal drainage capability, it is necessary that the auxiliary weft yarns have a smaller diameter than the papermaking side weft yarns.

The incorporation of the auxiliary weft yarns manifests the function which has never been attained by the conventional papermaking fabric.

First, the surface of the papermaking side fabric can be smoothed by disposing the auxiliary weft yarns in the recesses which are formed in the parts in which one of the two adjacent papermaking side warps directed from above the first papermaking side weft yarn to below the next papermaking side weft yarn between two adjacent papermaking side weft yarns and the other papermaking side warp directed from below the first papermaking side weft yarn to above the next papermaking side weft yarn intersect each other between the papermaking side weft yarns.

Then, the recesses can be filled and, at the same time, the ability of the fabric to retain the paper stock can be improved as by disposing the auxiliary weft yarns in the recesses to be formed between the papermaking side warps which are directed from above a first papermaking side weft yarn to below the next papermaking side weft yarn between the adjacent papermaking side weft yarns and the non-adjacent papermaking side warps which are directed from below a first papermaking side weft yarn to above the next papermaking side weft yarn.

Further, the irregularities of surface which are formed by the interaction between the recesses of warps and the knuckles of weft yarns can be eliminated as by disposing the auxiliary weft yarns over the papermaking side warps which are drawn downward between the knuckles of weft yarns.

Another characteristic feature of this invention resides in the fact that the parts of binding which are formed by the intersection of binding yarns with papermaking side warps on the upper side thereof are caused to occur in the parts adjoining the positions at which the auxiliary weft yarns are disposed above the papermaking side warps.

It has been empirically ascertained that when the papermaking fabric using the binding yarns is actually operated for the production of paper, the recesses at the parts of binding inflict a wire mark on the produced paper in spite of all efforts to preclude the trouble.

In the construction contemplated by this invention, the parts of binding in which the binding yarns intersect the papermaking side warps on the upper side thereof are caused to occur in the parts adjoining the positions at which the auxiliary weft yarns are disposed above the papermaking side warps. Thus, the recesses which occur, as an inevitable defect of the prior art, on the surface of the papermaking side fabric when the binding yarns draw the papermaking side fabric toward the running side in the parts of binding in which the binding yarns intersect the papermaking side warps of the papermaking side fabric on the upper side thereof are filled by the auxiliary weft yarns adjoining them. The papermaking fabric of this invention, accordingly, manifests a literally outstanding function of acquiring a papermaking surface smooth and devoid of recesses.

When the papermaking fabric is actually operated for the production of paper, therefore, there is absolutely no possibility of transferring such recesses onto the paper and inflicting a wire mark thereon.

Yet another feature of this invention resides in the fact that the binding yarns at least once intersect the papermaking side warps in a complete design of papermaking side weft yarns in the direction of weft yarns.

Owing to this construction, the papermaker fabric of this invention does not allow promiscuous existence of complete designs of papermaking side fabric drawn by the binding yarns and complete designs of papermaking side fabric not drawing thereby but enjoys uniform distribution of drawn portions throughout the entire area of the fabric.

As a result, the papermaking face is allowed to form a smooth surface more uniformly throughout the entire area thereof.

Now, the present invention will be described more specifically below with reference to the embodiments thereof.

FIG. 1 through FIG. 4 are diagrams showing complete design of repeating units of embodiments of this invention. In each diagram of design, warps are denoted by such Arabic numerals as 1, 2, 3, weft yarns by such Arabic numerals with a prime as 1', 2', 3', and auxiliary yarns are denoted by "a" and binding yarns by "b".

In the diagram, the cross "x" represents a position at which a papermaking side warp passes over a papermaking side weft yarn or an auxiliary weft yarn, and the open circle "o" a position at which a running side warp passes under a running side weft yarn and interlaces a running side weft yarn.

The solid triangle "▲" represents a position of the part of binding in which a binding yarn passes over a papermaking side warp and binds a papermaking side fabric and the open triangle "Δ" a position of the part of binding in which a binding yarn passes under a running side warp and binds a papermaking side fabric.

Figure 1:
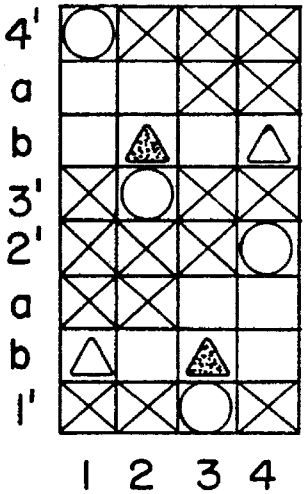
FIG. 1 is a design diagram showing a complete design of a repeating unit of one embodiment of this invention.

The embodiment of FIG. 1 comprises a 4-shaft papermaking side fabric having four wefts and four warps in a repeating unit, a 4-shaft running side fabric having four wefts and four warps in a repeating unit, and binding yarns serving to bind the two fabrics.

The reference numerals 1, 2, 3, and 4 stand for warps and papermaking side warps and running side warps are arranged vertically relative to each other.

The reference numerals 1', 4', 5', and 8' stand for weft yarns and papermaking side weft yarns and running side weft yarns are arranged vertically relative to each other.

The symbol "a" stands for an auxiliary weft yarn. The symbol "b" stands for a binding yarn.

First, in the papermaking side fabric, the papermaking side warp 1 passes over the papermaking side weft yarns 1', 2', and 3' and then passes under the papermaking side weft yarn 4' to form long crimps of the three papermaking side weft yarns on the papermaking side. The auxiliary weft yarn "a" and the binding yarn "b" shown in FIG. 1 are not included herein to show the lengths of the crimps of warps.

By the same token, the other papermaking side warps 2, 3, and 4 severally form long crimps of three papermaking side weft yarns on the papermaking side. It ought to be understood, therefore, that the papermaking side fabric forms long crimps of three papermaking side weft yarns on the papermaking side thereof.

The warp 2 passes over the weft yarns 1' and 2' and under the weft yarn 3'. It then passes over the weft yarn 4' of the next weave because the fabric is formed of repetitions of the diagram of complete design. Thus, the crimps of the warp 2 correspond to three weft yarns. The warp 4 likewise passes over the weft yarns 3', 4', and 1' and forms crimps of three weft yarns.

It is understood that the auxiliary weft yarn "a" is disposed between the papermaking side weft yarns 1' and 2' above the part in which the part of the papermaking side warp 3 directed from below the papermaking side weft 1' to above the papermaking side weft 2' and the part of the papermaking side warp 4 directed from above the papermaking side weft yarn 1' to below the papermaking side weft yarn 2' intersect each other, that the auxiliary weft yarn "a" is disposed between the papermaking side wefts 3' and 4' and over the part in which the part of the papermaking side warp 1 directed from above the papermaking side weft yarn 3' to below the papermaking side weft yarn 4' and the part of the papermaking side warp 2 directed from below the papermaking side weft yarn 3' to above the papermaking side weft yarn 4' intersect each other, that the two auxiliary weft yarns are disposed in the recess formed at the part at which one of two adjacent papermaking side warps directed from above the first papermaking side weft yarn to below the next papermaking side weft yarn and the other papermaking side warp directed from below the first papermaking side weft yarn to above the next papermaking side weft yarn intersect each other between two adjacent papermaking side weft yarns, and that the papermaking side fabric to be produced is relieved of the recesses, endowed with an improved ability to support fibers, and vested with a smooth surface.

Then, in the running side fabric, the running side weft yarn 1' in association with the following diagram of complete design is incorporated as passed under the running side warps 4, 1, and 2 and over the running side warp 3 and consequently made to form long crimps of three running side warps on the running side.

It is understood that the other running side weft yarns 2', 3', and 4' likewise are made to form long crimps of three running side wraps on the running side and that the running side fabric forms of weft wear type fabric having long crimps of three running side wraps formed on the running side thereof.

It is readily understood that the running side warps only naturally form long crimps of three running side weft yarns on the papermaking side opposite to the running side, namely that in the present embodiment, the running side warps form the same weave as the papermaking side fabric.

When the papermaking side fabric and the running side fabric are formed in an identical weave as in the present embodiment, they are at an advantage in enhancing the intimacy of bonding of the two fabrics and allowing the capacity of the papermaking fabric for retaining water to be lowered by decreasing the thickness of the fabric. Of course, the use of an identical weave is not critical for this invention. The most important thing is that the running side fabric is formed in a weft wear type. It is naturally permissible to form the two fabrics in different weaves or to alter the densities of yarns so that the numbers and densities of the warps and weft yarns of the running side fabric may be smaller than those of the papermaking side fabric.

Then with respect to the binding yarns, the binding yarn "b" which is disposed between the weft yarns 1' and 2' serves to connect the papermaking side fabric and the running side fabric by intersecting the papermaking side warp 3 on the upper side thereof and intersecting the running side warp 1 on the lower side thereof. The binding yarn "b" which is disposed between the weft yarns 3' and 5' likewise serves to connect the papermaking side fabric and the running side fabric by intersecting the papermaking side weft yarn 2 on the upper side thereof and intersecting the running side warp 4 on the lower side thereof.

It is understood that the part of binding which is formed by the binding yarn "b" intersecting the papermaking side warp 3 on the upper side thereof occupies the part adjoining the position at which the auxiliary weft yarn "a" is disposed over the papermaking side warps 3 and 4. It is further understood that since the binding yarn "b" intersects the papermaking side warp 3 on the upper side thereof and consequently draws the papermaking side fabric toward the running side, the recess suffered to occur on the surface of the papermaking side fabric is filled with the auxiliary weft yarn "a" enough to smooth the papermaking surface.

Similarly, it is understood that the part of binding which is formed by the binding yarn "b" of the weft yarns 3' and 5' intersecting the papermaking side warp 2 on the upper side thereof occupies the part adjoining the position at which the auxiliary weft yarn "a" is disposed over the papermaking side warps 1 and 2. It is further understood that since the binding yarn "b" intersects the papermaking side warp 2 on the upper side thereof and consequently draws the papermaking side fabric toward the running side, the recess suffered to occur on the surface of the papermaking side fabric is filled with the auxiliary weft yarn "a" enough to smooth the papermaking surface.

It is also understood that in the present embodiment, since the papermaking side fabric constitutes one complete design of complete design illustrated in FIG. 1, the two binding yarns "b" both form parts of binding in which they once intersect the papermaking side warp on the upper side thereof within the complete design. It is, therefore, understood that the binding yarns draw the papermaking side fabric toward the running side at intervals of a complete design of the papermaking side fabric without allowing promiscuous distribution of complete design of papermaking side fabric drawn by the binding yarns and complete design of papermaking side fabric not drawn thereby, draw the entire papermaking side fabric uniformly, and give rise to a further uniform and smooth papermaking face throughout the entire area.

It is to be noted, in the present embodiment, a slight difference of height occurs between the papermaking side warps 1 and 4 because the parts of binding in which the binding yarns intersect the papermaking side warps on the upper side thereof exist on the papermaking side warps 2 and 3 and they do not exist on the papermaking side warps 1 and 4.

The papermaking side warps 2 and 3 on which the parts of binding occur have a low height because they are drawn toward the running side. It is, therefore, desirable to eliminate the difference of height by giving a slightly larger diameter to the papermaking side warps 2 and than to the papermaking side warps 1 and 4.

In this embodiment, the binding yarns acquire an ample binding property because they intersect the papermaking side warps 2 and 3 and do not intersect the papermaking side warps 1 and 4.

Generally, it is desirable that at least 50% of the warps intersect the binding yarns, though this lower limit is variable with the size of a perfect design and the kind of binding yarns.

Figure 2:
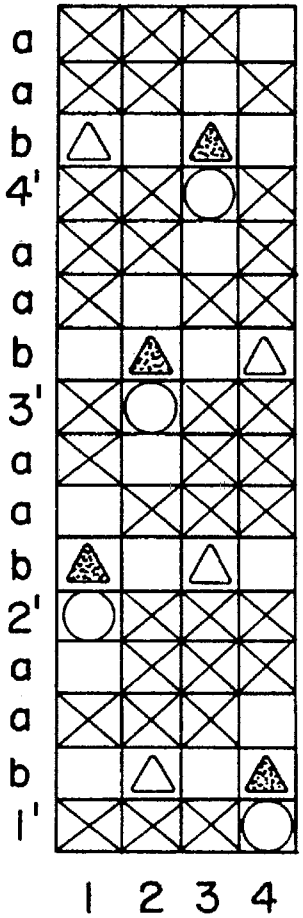
FIG. 2 is a design diagram showing a complete design of a repeating unit of another embodiment of this invention.

The embodiment of FIG. 2 comprises a 4-shaft papermaking side fabric, a 4-shaft running side fabric, and binding yarns for binding the two fabrics.

The reference numerals 1, 2, 3, and 4 stand for warps and the papermaking side warps and the running side warps are disposed vertically relative to each other.

The reference numerals 1', 2', 3', and 4' stand for weft yarns and the papermaking side weft yarns and the running side weft yarns are disposed vertically relative to each other.

The symbol "a" stands for an auxiliary weft yarns. The symbol "b" stands for a binding yarn.

First, in the papermaking side fabric, the papermaking side warp 1 passes under the papermaking side weft yarn 2' and over the papermaking side weft yarns 3' and 4' and the weft yarn 1' of the next design diagram and forms long crimps of three papermaking side wefts on the papermaking side.

It is understood that the other papermaking side warps 2, 3, and 4 likewise form long crimps of three papermaking side weft yarns on the papermaking side and the papermaking side fabric forms long crimps of three papermaking side weft yarns on the papermaking side.

The auxiliary weft yarns "a" are disposed between the papermaking side weft yarns 1' and 2' and above the part in which the papermaking side warp 1 is directed from above the papermaking side warp 1' to below the papermaking side weft yarn 2' and above the part in which the papermaking side warp 4 is directed from below the papermaking side warp 1' to above the papermaking side weft yarn 2'.

The auxiliary weft yarns "a" are likewise disposed between the papermaking side weft yarns 1' and 2' and these auxiliary weft yarns are disposed above the recesses which are formed by the papermaking side warp directed from above the first papermaking side weft yarn to below the next papermaking side weft yarn and the papermaking side warp directed from below the first papermaking side weft yarn to above the next papermaking side weft yarn between the papermaking side weft yarns.

It is understood that the other six auxiliary weft yarns "a" are likewise disposed and that the papermaking side fabric endowed with an improved ability to support fibers and vested with a smooth surface is consequently formed.

Then, in the running side fabric, the running side weft yarn 1' is interwoven by being passed under the running side warps 1, 2, and 3 and over the running side warp 4 and consequently allowed to form long crimps of three travelling face side warps.

It is understood that the other running side weft yarns 2', 3', and 4' likewise form long crimps of three running side warps on the running side and that the running side fabric is formed in a weft wear type having long crimps of three running side warps formed on the running side.

It is clearly understood that the running side warps form long crimps of three running side weft yarns on the side opposite to the running surface and give rise to the same weave as the papermaking side fabric.

When the papermaking side fabric and the running side fabric are formed in an identical weave as in the present embodiment, they are at an advantage in enhancing the intimacy of bonding of the two fabrics and allowing the capacity of the papermaking fabric for retaining water to be lowered by decreasing the thickness of the fabric. Of course, the use of an identical weave is not critical for this invention. The most important thing is that the running side fabric is formed in a weft wear type. It is naturally permissible to form the two fabrics in different weaves.

Then, as regards the binding yarns, the binding yarn "b" connects the papermaking side fabric and the running side fabric by intersecting the papermaking side warp 4 on the upper side thereof and intersecting the running side warp 2 on the lower side thereof. By the same token, the next binding yarn "b" effects the connection of the two fabrics by intersecting the papermaking side warp 1 on the upper side thereof and intersecting the running side warp 3 on the lower side thereof, the next binding yarn "b" by intersecting the papermaking side warp 2 on the upper side thereof and intersecting the running side warp 4 on the lower side thereof, and the next binding yarn "b" by intersecting the papermaking side warp 3 on the upper side thereof and intersecting the running side wrap 1 on the lower side thereof.

It is understood that the parts of binding formed by the binding yarns "b" intersecting the papermaking side warp 4 on the upper side thereof are caused to occur in the parts adjoining the positions at which the two auxiliary weft yarns "a" are disposed above the papermaking side warp 4. It is further understood that the papermaking surface is smoothed because the auxiliary weft yarns "a" fill the recesses which are suffered to occur on the surface of the papermaking side fabric when the binding yarns "b" intersect the papermaking side warp 4 and consequently draw the papermaking side fabric toward the running side.

It is understood that the parts of binding formed by the binding yarn "b" intersecting the papermaking side warp 1 on the upper side thereof adjoin the positions at which the auxiliary yarns "a" are disposed over the papermaking side warp 1. It is also understood that the papermaking surface is smoothed because the auxiliary weft yarns "a" fill the recesses which are suffered to occur on the surface of the papermaking side fabric when the binding yarns "b" intersect the papermaking side warp 1 on the upper side thereof and consequently draw the papermaking side fabric toward the running side.

The operation described above holds goods for the other binding yarns "b".

It is also understood that in the present embodiment, since the papermaking side fabric constitutes one complete design of complete design illustrated in FIG. 2, the four binding yarns "b" invariably forms party of binding in which they once intersect the papermaking side warp on the upper side thereof within the complete design. It is, therefore, understood that the binding yarns draw the papermaking side fabric toward the running side at intervals of a complete design of the papermaking side fabric without allowing promiscuous distribution of complete design of papermaking side fabric drawn by the binding yarns and complete design of papermaking side fabric not drawn thereby, draw the entire papermaking side fabric uniformly, and give rise to a further uniform and smooth papermaking surface throughout the entire area.

The present embodiment, unlike the first embodiment described above, does not need to give different diameters to the warps and the weft yarns because the parts of binding in which the binding yarns intersect the papermaking side warps on the upper side thereof are present on all the papermaking side warps and, therefore, no difference of height occur among the warps.

The embodiment of FIG. 3 comprises a 5-shaft papermaking side fabric having five wefts and five warps in a repeating unit and a 5-shaft running side fabric having five wefts and five warps in a repeating unit and binding yarns for connecting the two fabrics.

The reference numerals 1, 2, 3, 4, and 5 stand for warps and the papermaking side warps and the running side warps are disposed vertically relative to each other. The reference numerals 1', 2', 3', 4', and 5' stand for weft yarns and the papermaking side weft yarns and the running side weft yarns are disposed vertically relative to each other.

The symbol "a" stands for an auxiliary weft yarn. The symbol "b" stands for a binding yarn.

First, in the papermaking side fabric, the papermaking side warp 1 is passed over the papermaking side weft yarns 5', 1' 2' and 3' and then under the papermaking side weft yarn 4' and consequently allowed to form long crimps of four papermaking side weft yarns on the papermaking side.

It is understood that the other papermaking side warps 2, 3, 4, and 5 likewise form long crimps of four papermaking side warps on the papermaking side and that the papermaking side fabric forms long crimps of four papermaking side weft yarns on the papermaking side.

It is understood that the auxiliary weft yarns "a" are disposed above the part of the papermaking side warp 2 which is directed from below the papermaking side weft yarn 1' to above the papermaking side weft yarn 2', above the part of the papermaking side warp 5 which is directed from above the papermaking side weft yarn 1' to below the papermaking side weft yarn 2' and above the papermaking side warps 3 and 4 which are sunken downward the knuckles of the papermaking side weft yarns 1' and 2'.

It is further understood that the auxiliary weft yarns are disposed above the recesses formed by the papermaking side warps directed from above the first papermaking side weft yarn to below the next papermaking side weft yarn and the papermaking side warps directed from below the first papermaking side weft yarn to above the next papermaking side weft yarn and above the parts of the papermaking side warps sunken downward between the knuckles of the papermaking side weft yarns.

It is also understood that the other auxiliary weft yarns "a" are likewise disposed and that the papermaking side fabric to be formed is endowed with an improved ability to support fibers and vested with a smooth surface and, at the same time, the recesses in the papermaking side warps, the recesses between the knuckles of the papermaking side warps, and the protrusions of the knuckles of the weft yarns are eliminated, and the papermaking side fabric acquires exalted surface smoothness.

Then, as respects the running side fabric, the running side weft yarn 1' is interwoven by being passed under the running side warps 3, 4, 5, and 1 and above the running side warp 2 and consequently allowed to form long crimps of four running side warps on the running side.

It is understood that the other running side weft yarns 2', 3', 4', and 5' likewise form long crimps of four running side warps on the running side and that the running side fabric is formed in a weft wear type having long crimps of four running side weft yarns formed on the running side.

It is clearly understood that the running side warps form long crimps of four running side weft yarns on the paper side, i.e. the side opposite to the running, and form the same weave as the papermaking side fabric.

When the papermaking side fabric and the running side fabric are formed in an identical weave as in the present embodiment, they are at an advantage in enhancing the intimacy of bonding of the two fabrics and allowing the capacity of the papermaking for retaining water to be lowered by decreasing the thickness of the fabric. Of course, the use of an identical weave is not critical for this invention. The most important thing is that the running side fabric is formed in a weft wear type. It is naturally permissible to form the two fabrics in different weaves.

Then, as regards the binding yarns, the binding yarn "b" connects the papermaking side fabric and the running side fabric by intersecting the papermaking side warp 2 on the upper side thereof and intersecting the running side warp 4 on the lower side thereof. By the same token, the next binding yarn "b" effects the connection of the two fabrics by intersecting the papermaking side warp 5 on the upper side thereof and intersecting the running side warp 2 on the lower side thereof, the next binding yarn "b" by intersecting the papermaking side warp 3 on the upper side thereof and intersecting the running side warp 5 on the lower side thereof, and the next binding yarn "b" by intersecting the papermaking side warp 1 on the upper side thereof and intersecting the running side warp 3 on the lower side thereof.

It is understood that the parts of the binding formed by the binding yarn "b" intersecting the papermaking side warp 2 on the upper side thereof adjoin the positions at which the auxiliary weft yarns "a" are disposed above the papermaking side warps 2, 3, 4, and 5. It is also understood that the papermaking face is smoothed because the auxiliary weft yarns "a" fill the recesses which are suffered to occur on the surface of the papermaking side fabric when the binding yarns "b" intersect the papermaking side warp 2 on the upper side thereof and consequently draw the papermaking side fabric toward the running side.

The operation described above holds good for the other four binding yarns. It is understood that since the papermaking side fabric of the present embodiment constitutes one complete design of complete design illustrated in FIG. 3, the five binding yarns "b" invariably form parts of binding in which they once intersect the papermaking side warp on the upper side thereof within the complete design of the papermaking side fabric in the direction of weft yarns and the direction of warps. It is, therefore, understood that the binding yarns draw the papermaking side fabric toward the running side at intervals of a complete design of the papermaking side fabric without allowing promiscuous distribution of complete design of papermaking side fabric drawn by the binding yarns and complete design of papermaking side fabric not drawn thereby, draw the entire papermaking side fabric uniformly, and give rise to a further uniform and smooth papermaking surface throughout the entire area.

Figure 4:
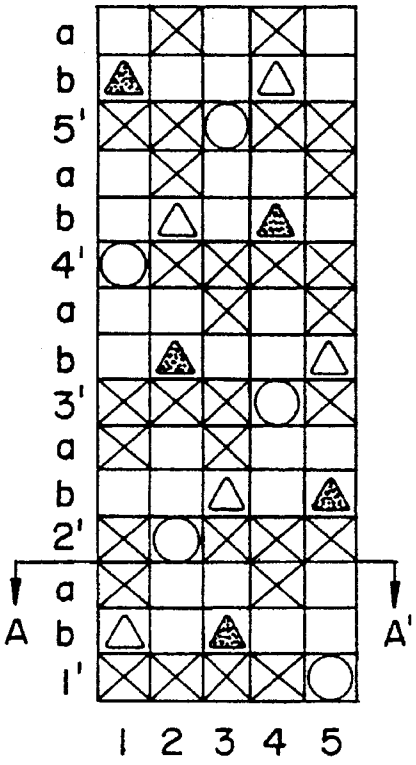
FIG. 4 is a design diagram showing a complete design of a repeating unit of a further embodiment of this invention.

The embodiment of FIG. 4 comprises a 5-shaft papermaking side fabric having five warps and five wefts in a repeating unit, a 5-shaft running side fabric having five warps and five wefts in a repeating unit, and binding yarns for connecting the fabrics.

The reference numerals 1, 2, 3, 4, and 5 stand for warps and the papermaking side warps and the running side warps are disposed vertically relative to each other. The reference numerals 1', 2', 3', 4', and 5' stand for weft yarns and the papermaking side weft yarns and the running side weft yarns are disposed vertically relative to each other.

The symbol "c" stands for an auxiliary weft yarn. The symbol "b" stands for a binding yarn.

First, in the papermaking side fabric, the papermaking side warp 1 is passed over the papermaking side weft yarns 5', 1', 2', and 3' and then under the papermaking side weft yarn 4' and consequently allowed to form long crimps of four papermaking side weft yarns on the papermaking side.

It is understood that the other papermaking side warps 2, 3, 4, and 5 likewise form long crimps of four papermaking side weft yarns on the papermaking side and that the papermaking side fabric forms long crimps of four papermaking side weft yarns on the papermaking side.

It is understood that the auxiliary weft yarns "a" are disposed above the part of the papermaking side warp 2 which is directed from above the papermaking side weft yarn 1' to below the papermaking side weft yarn 2', above the part of the papermaking side warp 5 which is directed from below the papermaking side weft yarn 1' to above the papermaking side weft yarn 2' and above the papermaking side warp 3 which is sunken downward between the knuckles of the papermaking side weft yarns 1' and 2'.

It is further understood that the auxiliary weft yarns are disposed above the recesses formed by the papermaking side warps directed from above the first papermaking side weft yarn to below the next papermaking side weft yarn and the papermaking side warps directed from below the first papermaking side weft yarn to above the next papermaking side weft yarn and above the parts of the papermaking side warps sunken downward between the knuckles of the papermaking side weft yarns.

It is also understood that the four other auxiliary weft yarns "a" are likewise disposed and that the papermaking side fabric to be formed is endowed with an improved ability to support fibers and vested with a smooth surface and, at the same time, the recesses formed by the papermaking side warps, the recesses formed by the sunken warps between the knuckles of the papermaking side weft yarns, and the irregularities of face due to the protrusions of the knuckles of the weft yarns are eliminated, and the papermaking side fabric is enabled to acquire a fine surface smoothness.

Then, in the running side fabric, the running side weft yarn 1' is interwoven by being passed under the running side wraps 1, 2, 3, and 4 and over the running side warp 5 and consequently allowed to form long crimps of four running side warps on the running side.

It is understood that the other papermaking side weft yarns 2', 3', 4', and 5' likewise form long crimps of four papermaking side warps yarns on the papermaking side and that the running side fabric is formed in a weft wear type having long crimps of four running side warps formed on the running side.

It is clearly understood that the running side warps naturally form long crimps of four running side weft yarns on the side opposite to the running and form the same weave as the papermaking side fabric.

When the papermaking side fabric and the running side fabric are formed in an identical weave as in the present embodiment, they are at an advantage in enhancing the intimacy of bonding of the two fabrics and allowing the capacity of the papermaker fabric for retaining water to be lowered by decreasing the thickness of the fabric. Of course, the use of an identical weave is not critical for this invention. The most important thing is that the running side fabric is formed in a weft wear type. It is naturally permissible to form the two fabrics in different weaves.

Then, as regards the binding yarns, the binding yarn "b" connects the papermaking side fabric and the running side fabric by intersecting the papermaking side warp 3 on the upper side thereof and intersecting the running side warp 1 on the lower side thereof. By the same token, the next binding yarn "b" effects the connection of the two fabrics by intersecting the papermaking side warp 5 on the upper side thereof and intersecting the running side warp 3 on the lower side thereof, the next binding yarn "b" by intersecting the papermaking side wrap 2 on the upper side thereof and intersecting the running side warp 5 on the lower side thereof, the next binding yarn "b" by intersecting the papermaking side warp 4 on the upper side thereof and intersecting the running side warp 2 on the lower side thereof, and the next binding yarn "b" by intersecting the papermaking side warp 1 on the upper side thereof and intersecting the running side warp 4 on the lower side thereof.

It is understood that the parts of binding formed by the binding yarn "b" intersecting the papermaking side warp 3 on the upper side thereof adjoining the positions at which the auxiliary weft yarns "a" are disposed above the papermaking side warps 2 and 3. It is also understood that the papermaking surface is smoothed because the auxiliary weft yarns "a" fill the recesses which are suffered to occur on the surface of the papermaking side fabric when the binding yarns "b" intersect the papermaking side warp 3 on the upper side thereof and consequently draw the papermaking side fabric toward the running side.

The operation described above holds good for the other four binding yarns. It is understood that since the papermaking side fabric of the present embodiment constitutes one complete design of complete design illustrated in FIG. 4 similarly to the whole papermaker fabric, the five binding yarns "b" invariably form parts of binding in which they once intersect the papermaking side warp on the upper side thereof within the complete design of the papermaking side fabric in the direction of weft yarns and the direction of warps. It is, therefore, understood that the binding yarns draw the papermaking side fabric toward the running side at intervals of a complete design of the papermaking side fabric without allowing promiscuous distribution of complete design of papermaking side fabric drawn by the binding yarns and complete design of papermaking side fabric not drawn thereby, draw the entire papermaking side fabric uniformly, and give rise to a further uniform and smooth papermaking face throughout the entire area.

The first through the fourth embodiments cited above represent the cases wherein the papermaking side fabric and the running side fabric possess complete design of one and the same size. This invention does not always require these two fabrics to possess complete design of an identical size. This invention, for example, allows the running side fabric to possess a large complete deign such that a plurality of complete designs of the papermaking side fabric may be superposed on and connected to each of the complete design of the running side fabric.

Figure 5:
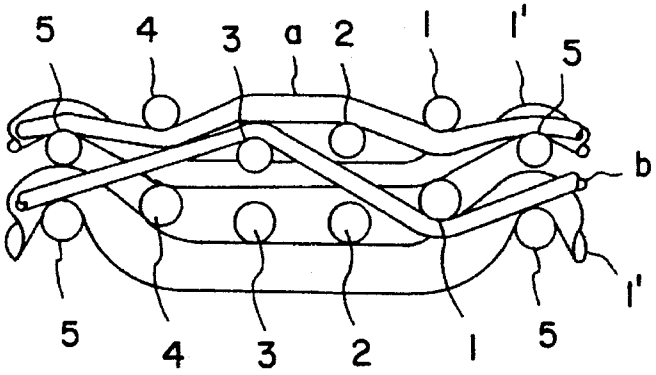
FIG. 5 is a cross section taken through FIG. 4 along the line A-A' and viewed in the direction of the arrows.

FIG. 5 is a cross section taken through FIG. 4 along the line A-A' and viewed in the direction of the arrows.

It is clearly remarked from this cross section that the binding yarn "b" intersects the papermaking side warp 3 on the upper side thereof and consequently draws the papermaking side fabric toward the running side and enables the auxiliary weft yarn "a" to fill the recess suffered to occur on the surface of the papermaking side fabric, with the result that the papermaking surface will acquire a smooth surface.

Figure 6:
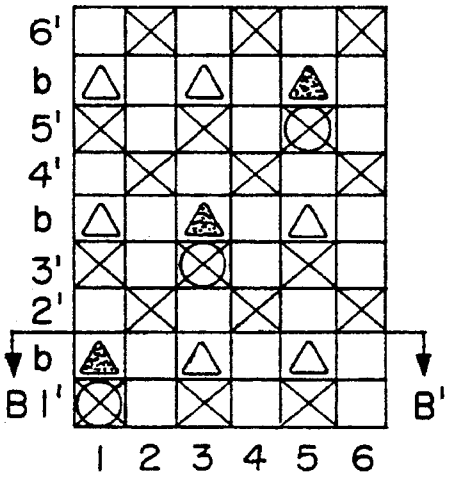
FIG. 6 PRIOR ART
FIG. 6 is a design diagram showing a typical example of the complete design of a repeating unit according to the conventional technique.
Figure 7:
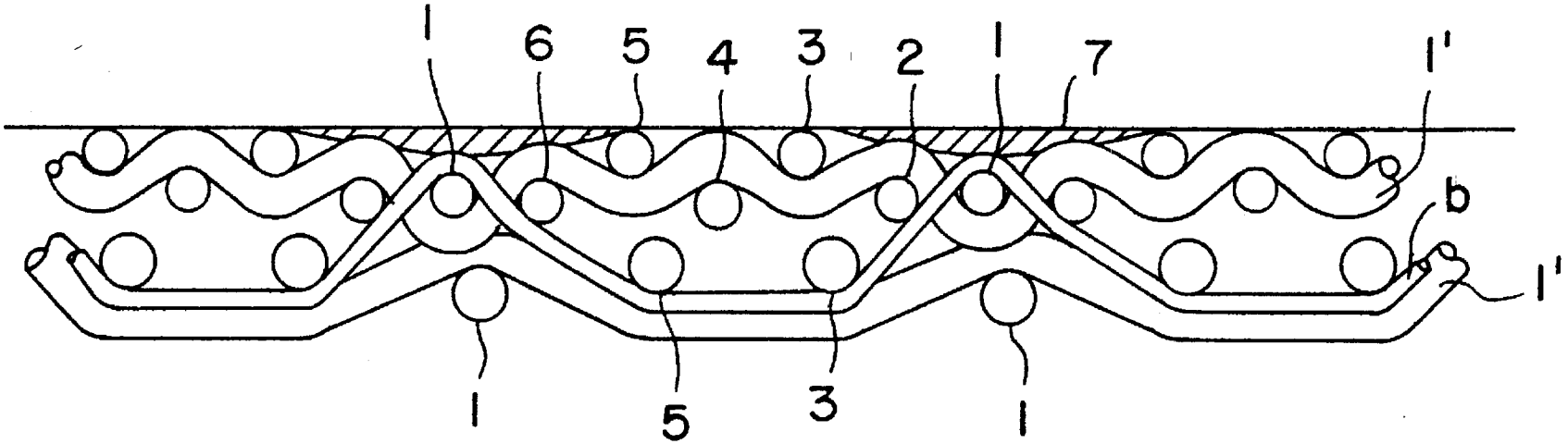
FIG. 7 Prior Art
FIG. 7 is a cross section taken through FIG. 7 along the line B-B' and viewed in the direction of arrows.

FIG. 6 is a design diagram of a complete design of a repeating unit obtained by a typical conventional technique and FIG. 7 is a cross section taken through FIG. 7 along the line B-B' and viewed in the direction of the arrows. As regards the complete design on the running side, since the number of running side warps is one half of the number of papermaking side warps and the running side warps are disposed in the parts 1, 3, and 5, the design diagram ought to be reviewed in terms of the warps 1, 3, and 5. Since the repeating weaves nevertheless begin from the warp 1, it is logical in the comprehension of the size of a complete design in this case to regard the complete design as comprising the parts 1 through 6 of warp disposition.

The discussion given above holds good for the weft yarns. Though no weft yarn exists at 6', the complete design is regarded as possessing a size enough to embrace weft yarn positions 1' through 6'.

The example of FIG. 6, from this point of view, comprises a 2-shaft plain-weave papermaking side fabric, a 3-shaft running side fabric composed of warps 1, 3, and 5, and binding yarns for binding the two fabrics. Naturally, no auxiliary weft yarn is incorporated in the papermaking side fabric. The reference numerals 1, 2, 3, 4, 5, and 6 stand for warps and the reference numerals 1', 2', 3', 4', 5', and 6' for weft yarns.

The numbers of warps and weft yarns on the running side are both one halves of those on the papermaking side. The symbol "b" stands for a binding yarn.

It is clearly remarked from FIG. 7 that the binding yarns "b" intersect the papermaking side warps 1 on the upper side thereof and consequently draw the papermaking side fabric toward the running side and give rise to a recess 7 on the surface of the papermaking side fabric. When the papermaking side fabric is actually used for the production of paper, therefore, it inflicts a wire mark on the produced paper.

It is further understood from the design diagram that since the papermaking side fabric has a 2-shaft plain weave, three complete designs each of papermaking side weft yarns and papermaking side warps of the papermaking side fabric are formed within the complete design of the entire fabric. It is, therefore, understood that the part of bonding formed by the bonding yarns intersecting the papermaking side warps on the upper side thereof is formed only once per three complete design of the papermaking side weft yarns in the direction of weft yarns and the direction of warps.

As a result, it is understood that the papermaking side fabric suffers promiscuous distribution of complete design of papermaking side fabric drawn by the binding yarns and complete design of papermaking side fabric not drawn thereby and that the papermaking surface cannot be smoothed uniformly throughout the entire area thereof.

The papermaking side weft yarns 1' allow the presence of three complete weaves which are formed by the interweaving of papermaking side warps 1 and 2, the papermaking side wraps 3 and 4, and the papermaking side warps 5 and 6 and the parts of binding with the binding yarns "b" are absent from the warps 1. As a result, the complete design which are formed by the interweaving of the papermaking side warps 1 and 2 are exclusively drawn toward the running side, whereas the complete design which are formed by the interweaving of the papermaking side warps 3 and 4 and the papermaking side wraps 5 and 6 are not drawn downward.

The papermaker fabric shown in FIG. 4 as one embodiment of this invention and the papermaker fabric shown in FIG. 6 as a typical example of the conventional technique were subjected to a comparative experiment to demonstrate the effect of the present invention.

The constructions of weaves and the results of tests are shown in Table 1.

| | | | Example | Conventional Example |
|---|---|---|---|---|
| Papermaking side | Warp | Material | PET | PET |
| | | Diameter (mm) | 0.17 | 0.17 |
| | | Density (number/inch) | 70 | 70 |
| | Weft | Material | PET | PET |
| | | Diameter (mm) | 0.17 | 0.17 |
| | | Density (number/inch) | 60 | 70 |
| | Auxiliary weft | Material | PA | |
| | | Diameter (mm) | 0.13 | |
| | | Density (number/inch) | 30 | |
| Running side | Warp | Material | PET | PET |
| | | Diameter (mm) | 0.20 | 0.20 |
| | | Density (number/inch) | 70 | 35 |
| | Weft | Material | PET, PA | PET, PA |
| | | Diameter (mm) | 0.30 | 0.30 |
| | | Density (number/inch) | 60 | 35 |
| Binding yarn | | Material | PA | PET |
| | | Diameter (mm) | 0.12 | 0.12 |
| | | Density (number/inch) | 60 | 35 |
| Bekk smoothness (sec.) | | | 92 | 77 |
| Wire marks | | | None | Yes |

Smoothness: A paper sheet having a basis weight of 70 g/m$^2$ was produced by treating a raw material pulp of medium-grade recipe with a TAPPI standard sheet machine and processed by the standard method into a smooth sheet. The face of the produced smooth paper sheet which had contacted the papermaking fabric was tested with a Bekk smoothness tester for the degree of smoothness of surface. A sample rated for a degree of smoothness of not higher than 80 has no practical value.

The wire mark was rated by visual observation.

In the sample obtained by the conventional technique, the parts of binding were sunken so much as to increase the paper thickness and manifest themselves in the form of continuous black lines. The sample according to this invention showed no sign of such a mark.

The papermaking fabric of this invention, though a one-piece product obtained by preparing a papermaking side fabric and a running side fabric with severally different warps and weft yarns and binding these two fabrics with binding yarns, is not suffered to form recesses on the surface of the papermaking side fabric at the positions corresponding to the parts of binding formed by the interweaving of the binding yarns and the papermaking side fabric. Thus, it excels in the smoothness of surface. When this papermaking fabric is actually used for the production of paper, it manifests an outstanding effect of vesting the produced paper with ample smoothness and imparting an exalted quality to the paper.

What is claimed is:

1. A two-ply warp two-ply weft papermaker fabric having auxiliary weft yarns incorporated in a papermaking side fabric thereof, which papermaker fabric comprises (a) an at least 3-shaft papermaking side fabric consisting of papermaking side warps and papermaking side weft yarns, forming long crimps of warps on the papermaking side thereof, and having auxiliary weft yarns of a smaller diameter than said warps incorporated in said papermaking side weft yarns, (b) a weft wear type running side fabric consisting of running side warps and running side weft yarns and having the running surface thereof formed of long crimps of said weft yarns, and (c) binding yarns intersecting said papermaking side warps on the upper side thereof and intersecting said running side warps on the lower side thereof thereby connecting said papermaking side fabric and said running side fabric.

2. A two-ply warp two-ply waft papermaking fabric set forth in claim 1, wherein binding parts formed by causing said binding yarns to intersect said papermaking side warps on the upper side thereof are disposed at the parts adjoining the positions at which said auxiliary weft yarns are disposed over said papermaking side warps.

3. A two-ply warp two-ply weft papermaking fabric set forth in claim 1, wherein said binding yarns form binding parts by at least once intersecting papermaking side warps thereover within complete design of papermaking side weft yarns in the direction of weft yarns and within complete weaves of papermaking side warps in the direction of warps.

4. A two-ply warp two-ply weft papermaking fabric set forth in claim 1, wherein the numbers and densities of papermaking side warps and running side warps are equal and the numbers and densities of papermaking side weft yarns and running side weft yarns are equal.

5. A two-ply warp two-ply weft papermaking fabric set forth in claim 1, wherein the diameter of said binding yarns is smaller than the diameter of papermaking side weft yarns.

6. A two-ply warp two-ply weft papermaking fabric set forth in claim 1, wherein the diameter of said running side weft yarns is larger than the diameter of said papermaking side weft yarns.

7. A two-ply warp two-ply weft papermaking fabric set forth in claim 1, wherein the diameter of said running side warps is larger than the diameter of said papermaking side warps.

8. A two-ply warp two-ply weft papermaking fabric set forth in claim 1, wherein a plurality of said auxiliary weft yarns are disposed between said papermaking side weft yarns.

9. A two-ply warp two-ply weft papermaking fabric set forth in claim 1, wherein said auxiliary weft yarns are disposed over warps at the positions at which one of two nonadjacent papermaking side warps is directed from above the first weft yarn to below the next weft yarn between two adjacent papermaking side weft yarns and over warps at the positions at which the other warp is directed from below the first weft yarn to above the next weft yarn and said auxiliary weft yarns are at least once interwoven with papermaking said warps in a complete design.

10. A two-ply warp two-ply weft papermaking fabric set forth in claim 1, wherein said auxiliary weft yarns are disposed over warps in the parts in which one of two adjacent papermaking side warps directed from above the first weft yarn to below the next weft yarn between two adjacent papermaking side weft yarns and the other warp directed from below the first weft yarn to above the next weft yarn intersect each other and said auxiliary weft yarns are at least once interwoven with papermaking side warps in a complete design.

11. A two-ply warp two-ply weft papermaking fabric set forth in claim 1, wherein said auxiliary weft yarns are disposed over warps at the positions at which one of two nonadjacent papermaking side warps is directed from above the first weft yarn to below the next weft yarn between two adjacent papermaking side weft yarns and over warps at the positions at which the other warp is director from below the first weft yarn to above the next weft yarns and further over warps sunken downward by being interwoven with weft yarns between said two warps and said auxiliary weft yarns are at least once interwoven with papermaking side warps in a complete design.

* * * * *